US006092490A

United States Patent [19]

Bairley et al.

[11] Patent Number: 6,092,490

[45] Date of Patent: Jul. 25, 2000

[54] HEAT RECOVERY STEAM GENERATOR

[75] Inventors: Donald W. Bairley, Windsor; Mark Palkes, Glastonbury, both of Conn.; Richard E. Waryasz, Longmeadow, Mass.

[73] Assignee: Combustion Engineering, Inc., Windsor, Conn.

[21] Appl. No.: 09/054,662

[22] Filed: Apr. 3, 1998

[51] Int. Cl.[7] ..... F22D 7/00

[52] U.S. Cl. ..... 122/7 R; 122/6 A; 122/235.23; 122/451.2

[58] Field of Search ..... 122/7 R, 6 A, 122/1 C, 235.23, 451.2, 406.3

[56] References Cited

U.S. PATENT DOCUMENTS

| | | | |
|---|---|---|---|
| 3,443,550 | 5/1969 | May et al. | 122/7 R |
| 3,807,364 | 4/1974 | Schwartz | 122/7 R |
| 4,261,301 | 4/1981 | Losel et al. | 122/406 S |
| 4,262,636 | 4/1981 | Augsburger | 122/7 R |
| 4,664,067 | 5/1987 | Haneda et al. | 122/7 R |
| 4,858,562 | 8/1989 | Arakawa et al. | 122/7 R |
| 5,159,897 | 11/1992 | Franke et al. | 122/6 A |
| 5,189,988 | 3/1993 | Budin et al. | 122/6 A |
| 5,293,842 | 3/1994 | Loesel | 122/7 R |
| 5,660,799 | 8/1997 | Motai et al. | 122/7 R |
| 5,701,850 | 12/1997 | Kohler et al. | 122/235.23 |
| 5,735,236 | 4/1998 | Kastner et al. | 122/6 A |
| 5,762,031 | 6/1998 | Gurevich | 122/1 C |
| 5,765,509 | 6/1998 | Liebig et al. | 122/1 C |
| 5,775,266 | 7/1998 | Ziegler | 122/7 R |

*Primary Examiner*—Philip H. Leung
*Assistant Examiner*—Jiping Lu
*Attorney, Agent, or Firm*—Alix, Yale & Ristas, LLP

[57] ABSTRACT

The water flow circuit for a heat recovery steam generator is a hybrid system which combines a circulating drum type circuit and a once-through circuit. A low pressure evaporator is designed for natural or forced circulation and a high pressure evaporator is designed for once-through flow. Orifices may be located in the inlet of the evaporator tubes for flow stability and an intermediate header between the evaporator and high pressure superheater improves stability, minimizes orifice pressure drop and equalizes pressure losses between evaporator tubes.

2 Claims, 4 Drawing Sheets

HEAT RECOVERY STEAM GENERATOR

BACKGROUND OF THE INVENTION

The present invention relates to heat recovery steam generators and particularly to their water flow circuits. Heat recovery steam generators are used to recover heat contained in the exhaust gas stream of a gas turbine or similar source and convert water into steam. In order to optimize the overall plant efficiency, they include one or more steam generating circuits which operate at selected pressures.

There are essentially three types of boilers as distinguished by the method of water circulation in the evaporator tubes. They are natural circulation, forced circulation and once-through flow. The first two designs are normally equipped with water/steam drums in which the separation of water from steam is carried out. In such designs, each evaporator is supplied with water from the corresponding drum via downcomers and inlet headers. The water fed into the circuits recovers heat from the gas turbine exhaust steam and is transformed into a water/steam mixture. The mixture is collected and discharged into the drums. In the natural circulation design, the circulation of water/steam mixture in the circuits is assured by the thermal siphon effect. The flow requirement in the evaporator circuits demands a minimum circulation rate which depends on the operating pressure and a local heat flux. A similar approach is taken in the design of a forced circulation boiler. The major difference is in the sizes of the tubing and piping and the use of circulating pumps which provides the driving force required to overcome the pressure drop in the system.

In both natural and forced circulation designs, the circulation rate and, therefore, the mass velocity inside the evaporative circuits is sufficiently high to ensure that evaporation occurs only in the nucleate boiling regime. This boiling occurs under approximately constant pressure (constant temperature) and is characterized by a high heat transfer coefficient in the boiling regime. Both of these factors result in the need for less evaporative surfaces. While the cost of evaporators is reduced, the cost of a total circulation system is high since there is a need for such components as drums, downcomers, circulating pumps, miscellaneous valves and piping, and associated structural support steel.

The third type of boiler is a once-through steam generator. These designs don't include drums and their small size start up system is less expensive than the circulation components of either a forced circulation or a natural circulation design. There is no recirculation of water within the unit during normal operation. Demineralizers may be installed in the plant to remove water soluble salts from the feedwater. In elemental form, the once-through steam generator is merely a length of tubing through which water is pumped. As heat is absorbed, the water flowing through the tubes is converted into steam and is superheated to a desired temperature. The boiling is not a constant pressure process (saturation temperature is not constant) and the design results in a lower log-mean-temperature-difference or logarithmic temperature difference which represents the effective difference between the hot gases and the water and/or steam. In addition, since the complete dryout of fluid is unavoidable, in once-through designs the tube inside heat transfer coefficient deteriorates as the quality of steam approaches the critical value. The inside wall is no longer wetted and the magnitude of film boiling is only a small fraction of the nucleate boiling heat transfer coefficient. Therefore, the lower logarithmic temperature difference and the lower inside tube heat transfer coefficient result in the need for a larger quantity of evaporator surface.

To minimize the increase in heating surface, a higher mass velocity is achieved by minimizing the number of the evaporative surface circuits. However, the high velocity required to achieve an appropriately higher heat transfer coefficient results in a higher pressure loss, a higher saturation temperature, and a further lowering of a logarithmic temperature difference. The impact on the surface requirement depends on operating pressure and it is relatively small for higher pressure designs above approximately 400 psig. It has, however, a significant impact on surface selection for a low pressure application below approximately 400 psig, making, in many cases, the once-through design impractical for low pressure application.

SUMMARY OF THE INVENTION

The present invention relates to a heat recovery steam generator and relates specifically to an improved water flow circuit for overall plant efficiency. The invention involves a hybrid heat recovery steam generator which combines a circulating drum type circuit and a once-through circuit thereby taking advantage of the best features of each circuit type while avoiding some of their disadvantages. More specifically, the invention involves an integrated system in which a low pressure evaporator is designed for natural or forced circulation and a higher pressure evaporator is designed for once-through flow.

DESCRIPTION OF THE PREFERRED EMBODIMENTS

Figure 1:
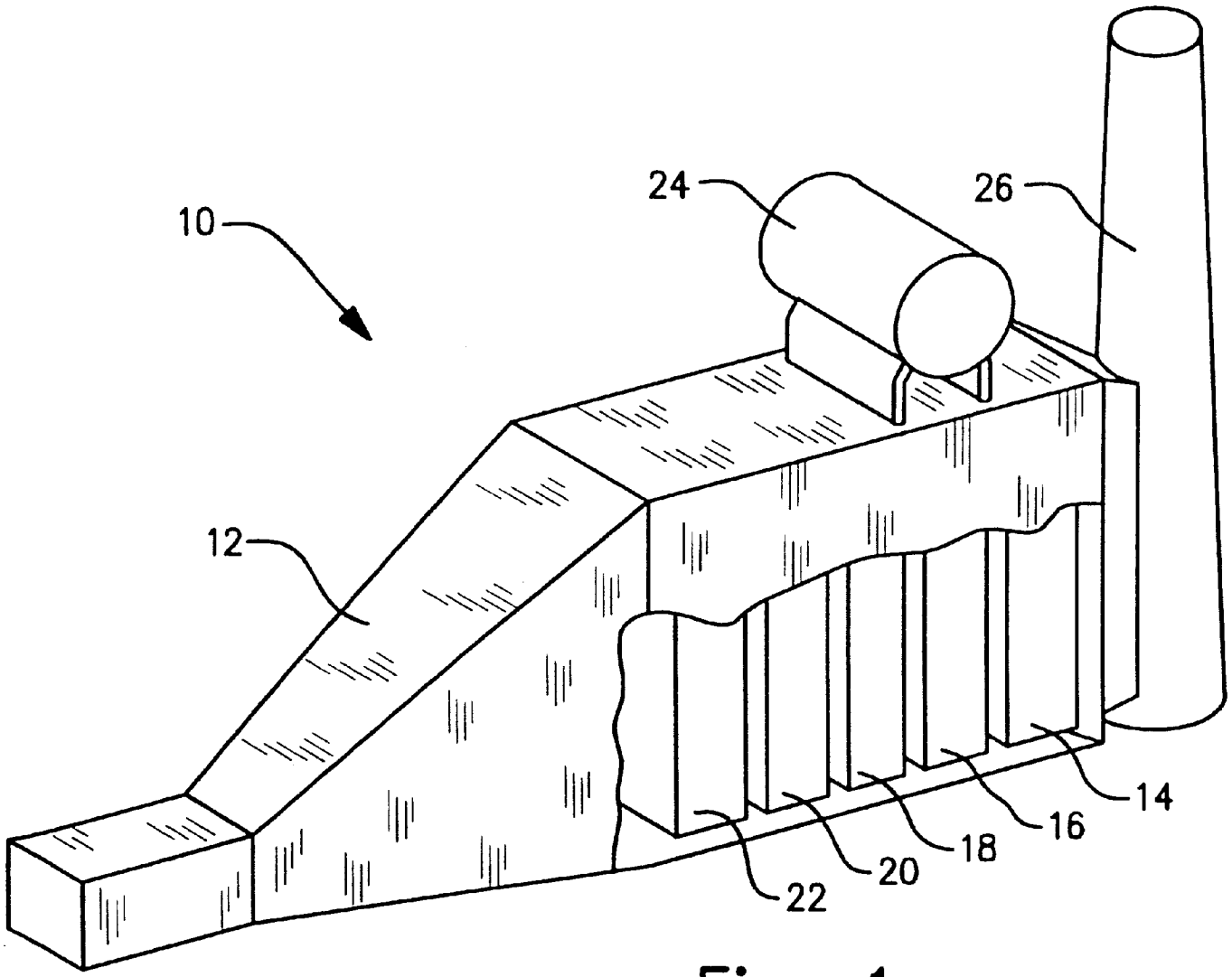
FIG. 1 is a general perspective view of a horizontal heat recovery steam generator.

FIG. 1 is a perspective view of a typical heat recovery steam generator generally designated 10. This particular unit is of the horizontal type but the present invention would be equally applicable to units with vertical gas flow. An example of the use of such heat recovery steam generators is for the exit gas from a gas turbine which has a temperature in the range of 425 to 670° C. (about 800 to 1,240° F.) and which contains considerable heat to be recovered. The generated steam can then be used to drive an electric generator with a steam turbine or may be used as process steam.

The heat recovery steam generator 10 comprises an expanding inlet transition duct 12 where the gas flow is expanded from the inlet duct to the full cross-section containing the heat transfer surface. The heat transfer surface comprises the various tube banks 14, 16, 18, 20 and 22 which may, for example, comprise the low pressure economizer, the low pressure evaporator, the high pressure economizer, the high pressure evaporator and the high pressure superheater respectively. Also shown in this FIG. 1 is a steam drum 24 and the flue gas stack 26. The present invention involves the arrangement and the operating conditions of this heat exchange surface.

Figure 2:
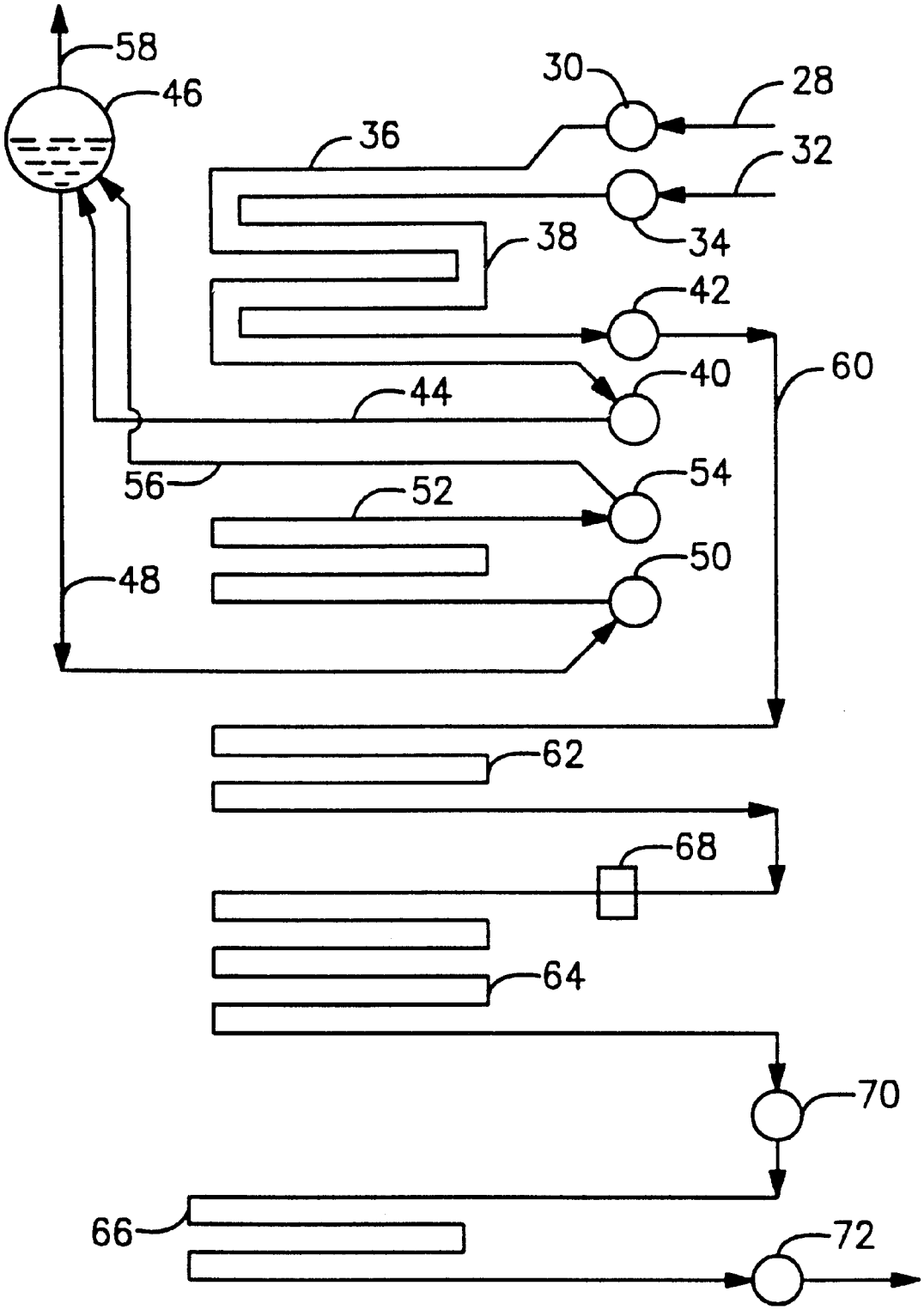
FIG. 2 is a schematic flow diagram illustrating a steam generator flow circuit of the present invention employing natural circulation.

FIG. 2 schematically illustrates the arrangement of the heat exchange surface for one of the embodiments of the present invention. Beginning with the feedwater, the low pressure feedwater 28 is fed to the collection/distribution header 30 and the high pressure feedwater 32 is fed to the collection/distribution header 34. The low pressure feedwater is then fed from the header 30 into the low pressure economizer tube bank represented by the circuit 36 while the high pressure feedwater is fed from the header 34 into the high pressure economizer tube bank represented by the circuit 38. The partially heated low pressure flow from the low pressure economizer tube bank 36 is collected in the header 40 and the partially heated high pressure flow from the high pressure economizer tube bank 38 is collected in the header 42.

The partially heated low pressure flow from the header 40 is fed via line 44 to the low pressure steam drum 46. The purpose of the steam drum 46 is the conventional task of separating steam from liquid as will be noted later. The separated water from the steam drum 46 is discharged through the downcomer 48 into the distribution header 50. The flow from the header 50 is through the low pressure evaporator 52 where the evaporation to steam occurs. The direction of flow in the low pressure evaporator 52 may either be horizontal or upward. The steam, most likely saturated steam, is collected in the header 54 and then fed via line 56 back to the steam drum 46. The feed 56 and the feed 44 to the steam drum 46 are mixed and the steam/liquid mixture is separated into steam, which is discharged at 58, and liquid water which is discharged through the downcomer 48. As can be seen, this low pressure circuit is a natural circulation circuit in which flow is induced by the density differences between the fluid in downcomers and evaporative circuits.

Turning now to the high pressure, once through circuit, the partially heated high pressure stream 60 from the collection header 42 is fed in series through the second high pressure economizer tube bank 62, the high pressure evaporator 64 and into the high pressure superheater 66. The flow in the high pressure evaporator can be either upward, horizontal or downward. Orifices designated 68 may be installed in the inlet of each tube of the evaporator tube bank 64 for flow stability. An intermediate header 70 between the evaporator 64 and the high pressure superheater 66 improves stability and minimizes orifice pressure drop. This intermediate header 70 equalizes pressure loss between the tubes of the high pressure evaporator 64 and minimizes the effect of any flow or heat disturbances in the superheater 66 on the evaporator 64. The superheated steam is then collected in and discharged from the header 72. As can be seen, this high pressure circuit is a once-through circuit all the way from the high pressure feed 32 to the outlet header 72.

Figure 3:
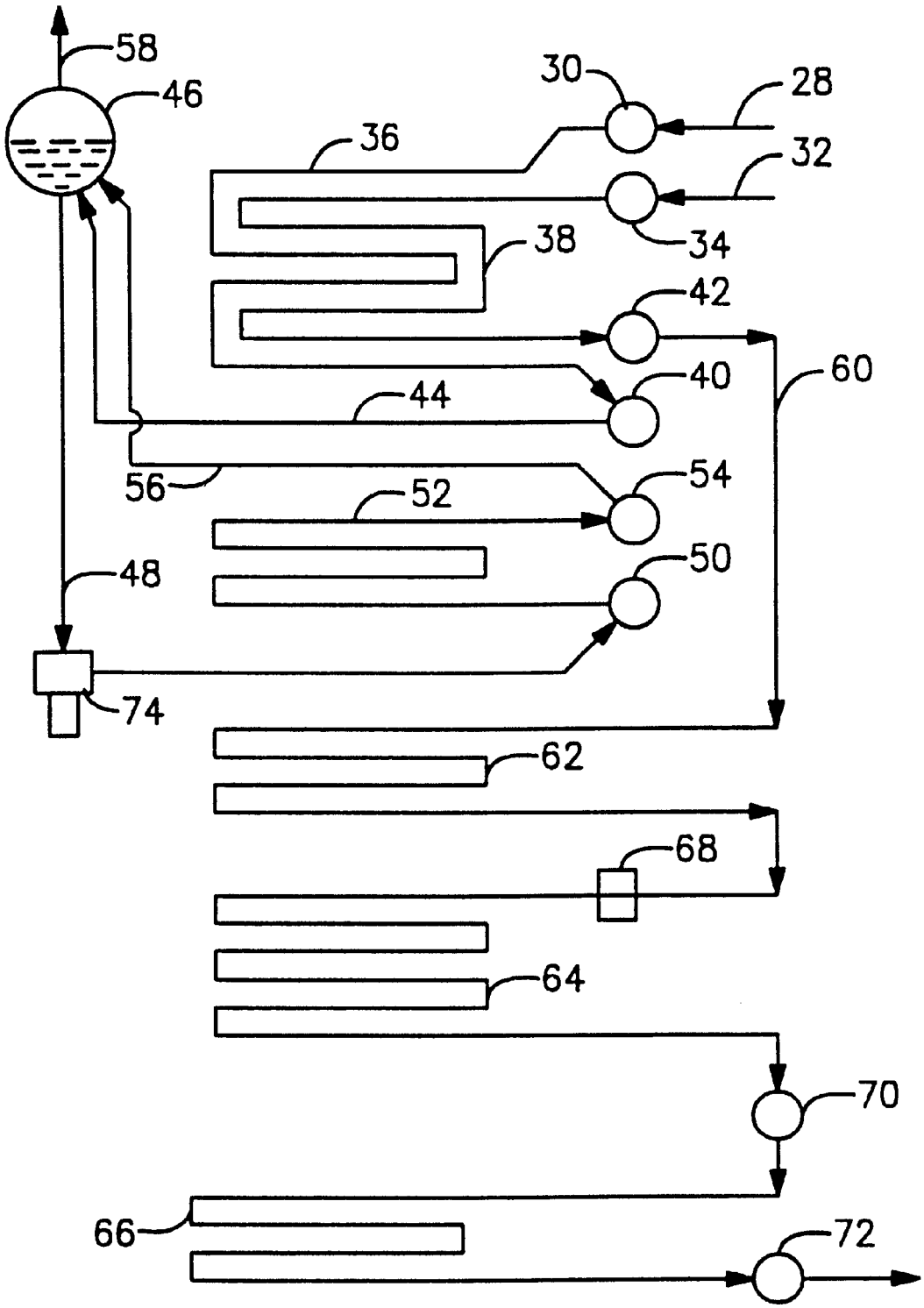
FIG. 3 is a schematic flow diagram similar to FIG. 2 but directed to forced circulation.

FIG. 3 shows heat recovery steam generator flow arrangement almost identical to the arrangement of FIG. 2 except that the low pressure circuit is now a forced circulation loop with the addition of the circulating pump 74.

Figure 4:
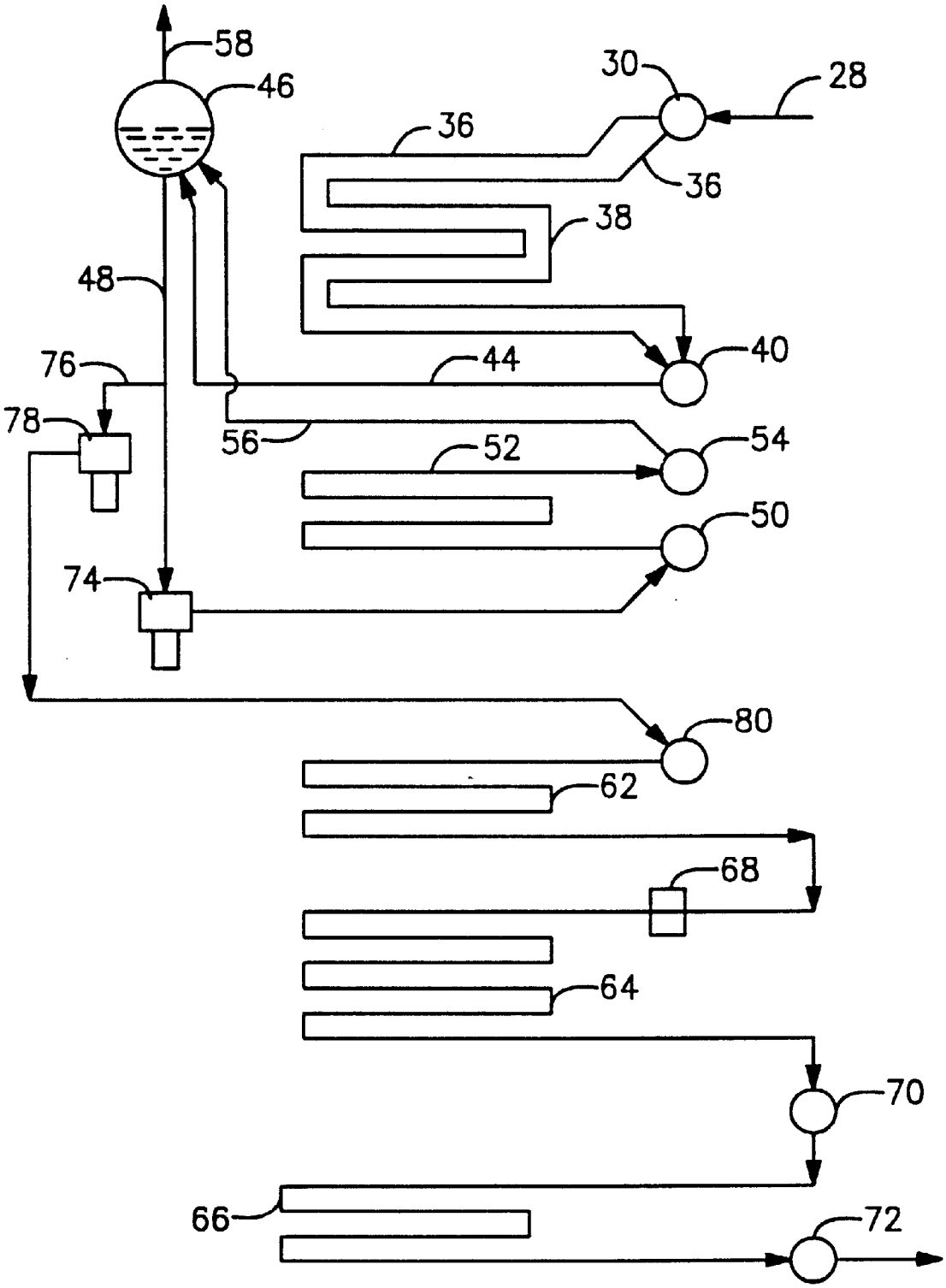
FIG. 4 is another schematic flow diagram showing a variation of the present invention.

FIG. 4 is another variation of the present invention in which the initial heating of the water for the once-through, high pressure circuit is done in the low pressure, forced circulation circuit. As can be seen, all of the feed is now at 28 into the distribution header 30 and then into the low pressure economizer tube bank 36. Since the quantity of the low pressure feed 28 is now increased, there needs to be increased heating capacity of the low pressure economizer. This is illustrated by the double low pressure economizers 36. The output of the low pressure economizer is collected at 40. Just as in the FIG. 3 embodiment, the total low pressure economizer output then flows via line 44 to the steam drum 46. The liquid in the downcomers 48 from the steam drum in this embodiment is split into a low pressure flow and a high pressure flow. The liquid for the low pressure, forced circulation circuit again goes to the circulating pump 74 and is circulated in the low pressure, forced circulation circuit just as in FIG. 3.

The liquid for the high pressure, once-through circuit is withdrawn at 76 via a separate downcomer system into the high pressure feedwater pump 78 and fed at the high pressure to the distribution header 80. From that point, the high pressure, once-through circuit is the same as that shown in FIGS. 2 and 3.

As can be seen, the present invention is a hybrid heat recovery steam generator which embodies the best features of a circulating/drum type design and a once-through design. This design offers cost advantages over either a traditional natural/forced circulation design or a once-through design.

We claim:

1. In a heat recovery steam generator wherein heat is recovered from a hot gas flowing in heat exchange contact with steam generating circuits, said steam generating circuits comprising:

a. a low pressure steam generating circuit comprising a low pressure economizer section having an outlet connected to a steam separating drum for separating low pressure steam from liquid water and having a separated water outlet, a low pressure evaporator section having an inlet connected to said steam drum water outlet and an outlet connected back into said steam drum and said steam drum further including a separated low pressure steam outlet; and b. a high pressure steam generating circuit comprising a high pressure economizer section with a plurality of parallel tubes each having an outlet, a high pressure evaporator section with a plurality of parallel tubes each having an inlet and an outlet, means connecting each of said plurality of parallel tubes of said economizer section with one of said plurality of parallel tubes of said evaporator section including flow stabilizing orifices in each connecting means, a pressure equalizing header connected to the outlets of said plurality of parallel tubes of said evaporator section and a high pressure superheater section with a plurality of parallel tubes connected to said pressure equalizing header and having high pressure steam outlets.

2. In a heat recovery steam generator as recited in claim 1 and further including means for withdrawing and increasing the pressure of a portion of the separated water at said separated water outlet of said steam drum and feeding said portion to said high pressure economizer.

* * * * *